US005777635A

United States Patent [19]

James, III et al.

[11] Patent Number: 5,777,635

[45] Date of Patent: Jul. 7, 1998

[54] AUTOMATIC PRINTHEAD-TO-PAPER GAP ADJUSTMENT

[75] Inventors: Edmund Hulin James, III, Lexington, Ky.; Gregory Willis Peterson, Maineville, Ohio

[73] Assignee: Lexmark International, Inc., Lexington, Ky.

[21] Appl. No.: 593,311

[22] Filed: Jan. 31, 1996

[51] Int. Cl.[6] ..... B41J 25/308

[52] U.S. Cl. ..... 347/8

[58] Field of Search ..... 347/8, 86, 104

[56] References Cited

U.S. PATENT DOCUMENTS 5,366,301 11/1994 Martin et al. ..... 347/8
5,468,076 11/1995 Hirano et al. ..... 347/8

FOREIGN PATENT DOCUMENTS 0 334 548 A2 9/1989 European Pat. Off. ..... B41J 25/30
0 519 495 A2 12/1992 European Pat. Off. ..... B41J 25/308
60132763 7/1985 Japan ..... B41F 17/34
61123561 6/1986 Japan ..... B41J 25/28
2 057 956 4/1981 United Kingdom ..... B26D 7/26

*Primary Examiner*—Stuart N. Hecker
*Attorney, Agent, or Firm*—James J. McArdle, Jr.

[57] ABSTRACT

An ink-jet printer includes a cartridge having a presser foot thereon for adjusting the gap distance between the ink-ejecting nozzles of a cartridge carried by the carrier and the surface of a sheet of paper which receives the ejected ink. The presser foot is spring biased and slidably mounted on the carrier for movement in a direction generally normal to the plane of the paper. Cartridges are provided with surface features which vary according to the optimum nozzle-to-paper gap distance for best print quality. When a cartridge is mounted on the carrier, the surface feature on the cartridge moves the presser foot toward the paper feed path to automatically adjust the nozzle-to-paper gap distance to the optimum distance for the mounted cartridge. The surface features on the cartridges may be recesses of varying depths or projections of varying heights.

12 Claims, 4 Drawing Sheets

AUTOMATIC PRINTHEAD-TO-PAPER GAP ADJUSTMENT

RELATED APPLICATIONS

This application incorporates by reference the disclosure of Cseledy et al. copending application Ser. No. 08/149,434, assigned to the same assignee as the present application.

FIELD OF THE INVENTION

The present invention relates to ink-jet printers and more particularly to a method and apparatus for adjusting the spacing between ink ejecting nozzles on a printhead and the surface of a record on which the ink is deposited.

BACKGROUND OF THE INVENTION

In an ink-jet printer, a sheet of paper or other record is advanced past a print station where droplets of ink are ejected onto the paper from a nozzle array carried by a printhead. In a so-called serial drop on demand printer, the printhead is provided with a nozzle array of limited width and as the paper is fed along a paper feed path past the print station the printhead reciprocates parallel to the plane of the record feed path and transverse to the direction of paper feed as ink droplets are ejected from the nozzles onto the paper to accomplish printing.

Ink-jet printers provide better print quality when the gap between the nozzles on the printhead and the surface of the paper is set to some optimum distance. Typically, the gap distance has been obtained by providing a presser foot immovably fixed relative to the printhead carrier, the presser foot extending into the paper feed path so as to maintain the paper a minimum distance from the nozzle array as the paper moves past the print station. A force is applied to the paper to urge it toward the presser foot so as to maintain the paper in contact with the bottom of the presser foot, thereby setting the minimum distance.

The printhead typically comprises a replaceable cartridge having an ink reservoir therein and a nozzle array on one surface. When the supply of ink in a cartridge is depleted, the entire cartridge is replaced. As better inks are developed and nozzle geometries are improved, it would be desirable to be able to use improved printheads in existing printers. However, the optimum print gap distance is not a fixed value but instead varies according to various factors including ink formulation, printhead geometrical design and printhead operating parameters. Therefore, an improved printhead, say one with an improved ink formulation, when inserted into a printer having the gap permanently set during manufacture by a presser foot immovably fixed to the printhead carrier, may yield less than its potentially best print quality because its optimum gap distance is different from the gap distance set during manufacture. The the optimum gap may be achieved by changing the geometry of the cartridge but this would require a costly re-tooling.

SUMMARY OF THE INVENTION

A primary objective of the invention is to provide a method and apparatus for adjusting the print gap distance between a record and cartridges selectively mounted on a printhead carrier whereby the gap distance may be varied for cartridges of different designs.

An object of the present invention is to provide a printhead carrier for an ink-jet printer, the carrier having a presser foot which is movable in a direction generally normal to the plane of a record feed path to vary the print gap distance between a printhead cartridge and a record.

Another object of the invention is to provide a cartridge having ink-ejecting nozzles in a surface thereof, and a carrier, the carrier having thereon a spring biased presser foot movable generally normal to the plane of a record feed path for setting the nozzle-to-record gap distance, the cartridge having thereon a surface engaging the presser foot to adjust the position of the presser foot in a direction normal to the record feed path whereby the nozzle-to-record gap distance is determined by the cartridge.

Yet another object of the invention is to provide an ink-jet printer having a cartridge carrier for selectively supporting ink cartridges of different types, the cartridge carrier having thereon a spring biased presser foot adjustable to provide different cartridge-to-record gap distances whereby the gap distance for optimum print quality is obtained for cartridges requiring different gap distances to obtain optimum print quality.

Still another object of the invention is to provide a cartridge for an ink-jet printer, the cartridge having a surface feature which determines the nozzle to record gap distance. The surface feature may be varied between different types of cartridges by providing a different surface feature on each type requiring a given print gap distance for optimum print quality. The surface feature may be a recess in a cartridge, a projection on a cartridge, or even a flat surface. The surface feature presses a presser foot toward the record feed path against the force of a bias spring as the cartridge is mounted on the cartridge carrier to thereby automatically adjust the print gap.

Other objects and advantages of the invention and the manner of making and using it will be obvious upon consideration of the following description and the accompanying drawings.

DETAILED DESCRIPTION OF THE INVENTION

The invention will be described with reference to a platenless printer as shown and described in the copending application referenced above but it will be understood that the invention may also be used in printers wherein a bedplate is disposed on the side of the record feed path opposite the print station, provided of course that the bedplate is moveable or spaced sufficiently far from the feed path so that a presser foot may adjust the nozzle to record gap distance by moving a record to the proper position as subsequently described.

In the following description and claims, various terms such as "top", "bottom", "up", "down", "vertical" and "horizontal" are used to simplify the explanation of the invention. However, these terms are intended as terms of reference rather than limitation.

Figure 2:
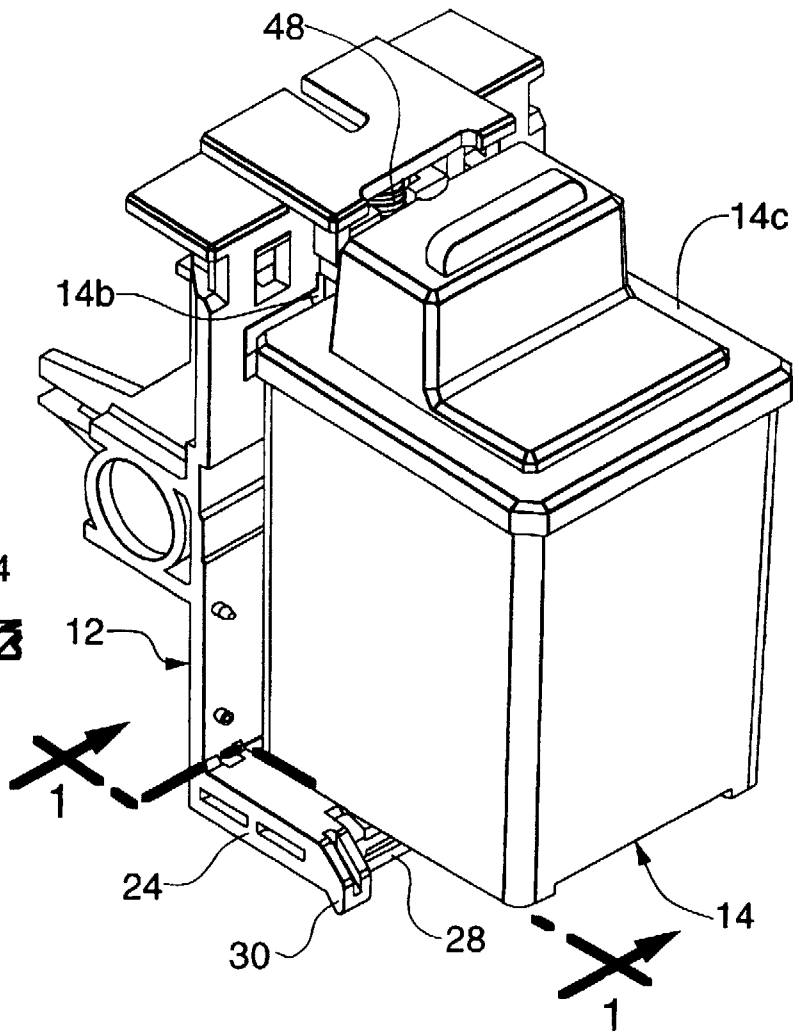
FIG. 2 is a perspective view of a cartridge and cartridge carrier.
Figure 1:
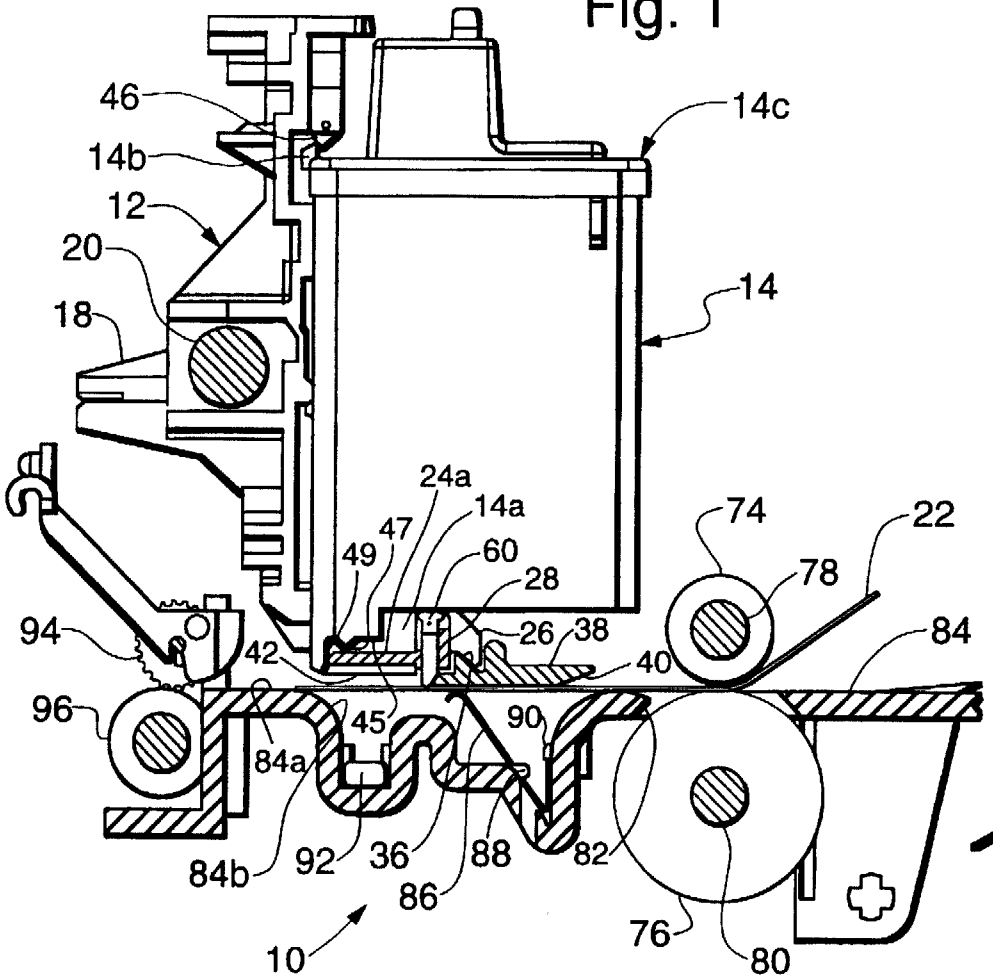
FIG. 1 is a schematic side view, partly in section, illustrating a print station in an ink-jet printer.

As schematically shown in FIG. 1, a print station 10 for a platenless serial drop on demand ink-jet printer includes a printhead assembly comprising a cartridge carrier 12 and a cartridge 14. A drive belt (not shown) is secured to two attachment points 18, only one attachment point being visible in FIG. 1. The carrier 12 is slidably mounted on a guide rod 20 which extends parallel to the plane in which a record 22 is fed through the print station. A motor (not shown) drives the belt in a conventional manner to move the carrier 12 back and forth on guide rod 20 transverse to the direction of record feed through the print station.

Figure 4:
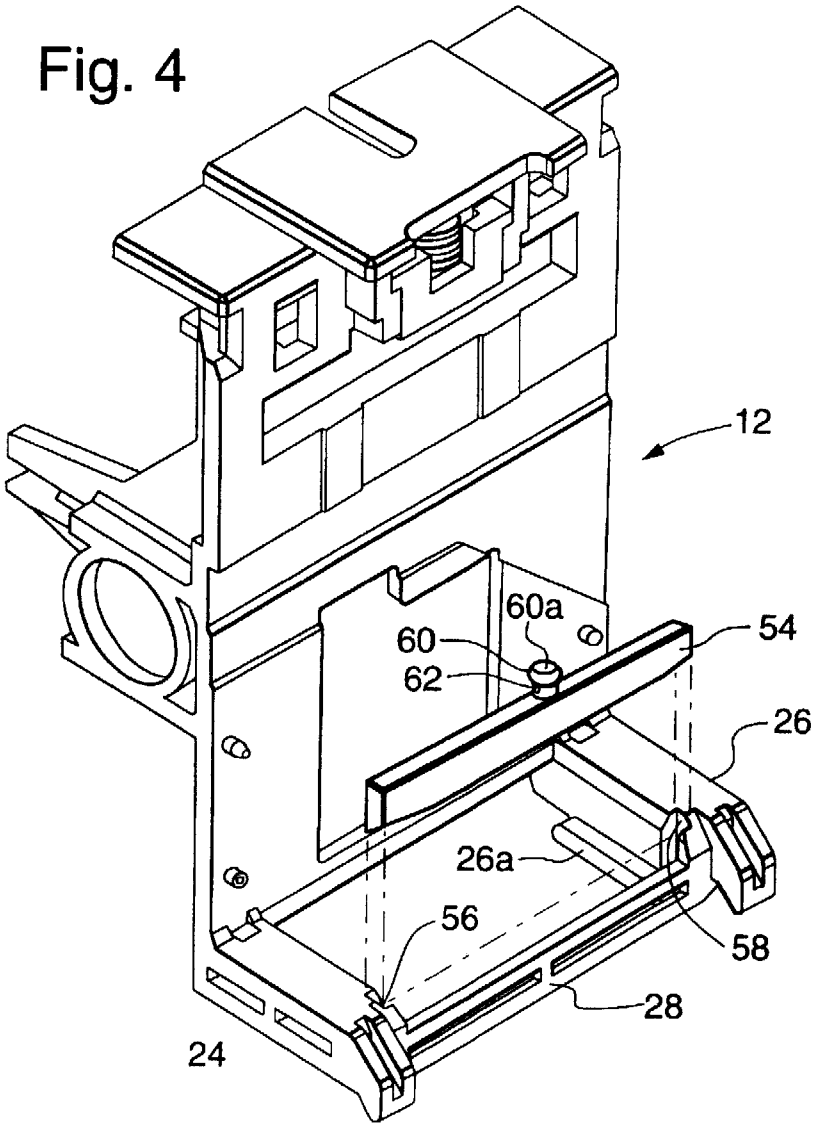
FIG. 4 is an exploded perspective view of a cartridge carrier according to the invention.
Figure 3:
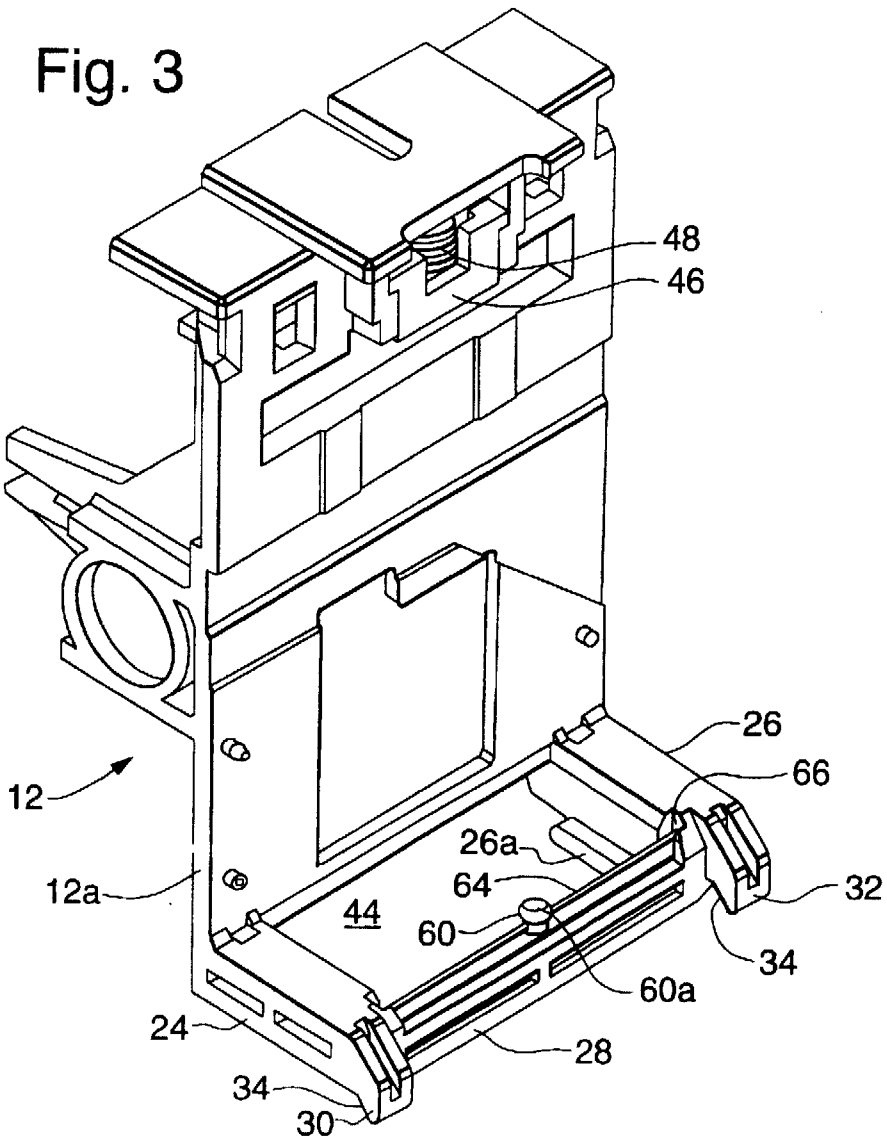
FIG. 3 is a perspective view of the cartridge carrier with the cartridge removed.

The carrier 12 is generally L-shaped as shown in FIGS. 3 and 4 and has two generally horizontally extending arms 24, 26 and a bracing bar 28 joining the arms. Arms 24 and 26 are provided with support feet 30 and 32 respectively. Each foot has a sloping surface 34 which rides on a sloping surface 36 (FIG. 1) of a groove provided in a guide rail 38. The guide rail 38 is mounted to side frames (not shown) as described in the aforementioned application.

The carrier 12 is pivotable about guide rod 20 and the center of mass of the carrier is to the right of the guide rod as shown in FIG. 1 so that the carrier tends to pivot clockwise about the guide rod. Engagement of support foot surfaces 34 with the groove 36 in guide rail 38 limits this pivoting movement of the carrier. The guide rail 38 is provided with a sloping surface 40 facing upstream of the direction of record travel so that records are deflected downwardly and pass under the guide rail as they are fed into the print station.

Except for a surface feature subsequently described, the cartridge 14 is of conventional design hence the internal configuration of the cartridge is not shown. The cartridge may be a monochrome cartridge having one ink reservoir therein, or a color cartridge having three ink reservoirs therein. The cartridge 14 is molded to have a downwardly extending nose portion 14*a* and a nozzle plate 42 is recessed in the bottom surface of the nose. Internal ink flow passages connect the reservoir(s) to an array of nozzles in the nozzle plate 42 and the nozzle plate includes a plurality of resistive heaters for selectively heating the ink(s) to thereby selectively eject ink from the nozzles onto the top surface of record 22.

As seen in FIGS. 3 and 4, the arms 24, 26, brace bar 28 and vertical portion 12*a* of the carrier 12 define an opening 44. The arms 24, 26 are provided with respective lands or horizontal shelves 24*a* (FIG. 1) and 26*a* (FIG. 3). The opposing side surfaces of the cartridge nose portion 14*a* are each provided with a recess 45 (FIG. 1) which extends to the bottom surface of the nose portion and the wall of each recess includes two downwardly extending projections 47, 49.

The projections 47, 49 serve to accurately position cartridge 14 relative to the cartridge carrier 12. The cartridge is mounted on the carrier by tilting the top of the cartridge to the right as viewed in FIG. 1 as the nose portion 14*a* is inserted through opening 44. As the cartridge is inserted, projections 49 slide downwardly past the downstream ends of lands 24*a*, 26*a* until the projections 47 engage the top surfaces of the lands. The top of the cartridge is then tilted counter-clockwise.

The cartridge 14 is provided with an upwardly extending projection 14*b* (FIG. 1). The assignee of the present application manufactures interchangeable color and monochrome cartridges, the color cartridges having the projection 14*b* on the cartridge body and the monochrome cartridges having the projection on the lid 14*c* which covers the top of the cartridge. Regardless of the type of cartridge, as the cartridge nose portion 14*a* is inserted into opening 44 and the cartridge tilted counter-clockwise, the projection 14*b* forces a slidable latch element 46 upwardly. Latch element 46 is biased by a relatively strong compression spring 48 (FIG. 3) and when the cartridge 14 is in position against the vertical portion 12*a* of the carrier the latch element snaps behind projection 14*b* and holds the cartridge in position.

Figure 5:
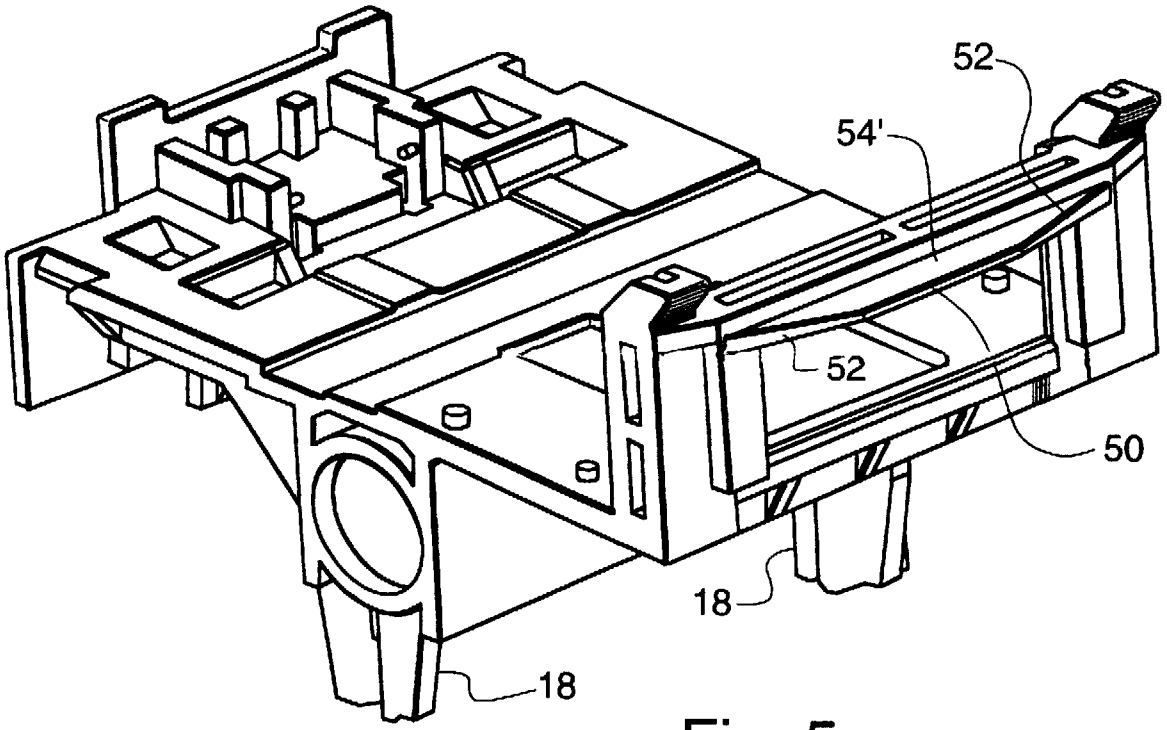
FIG. 5 is a perspective view of a cartridge carrier showing the shape of the presser foot.
Figure 6:
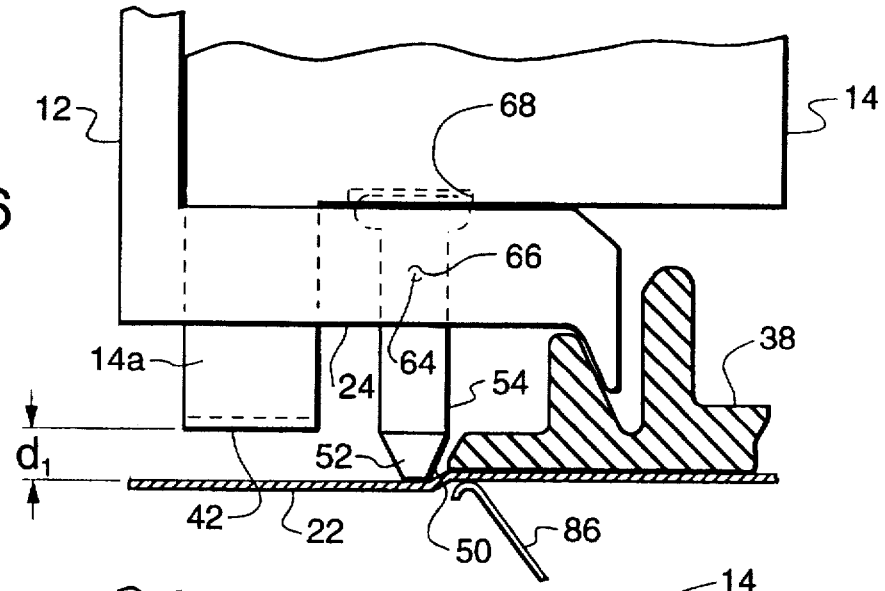
FIG. 6 is a schematic diagram, enlarged and not to scale, illustrating operation of the presser foot in combination with a cartridge having a recessed surface which acts against the presser foot so as to provide a nozzle to record gap distance $d_1$.

Prior art printers are provided with a presser foot 54' (FIG. 5) integral with the carrier 12 for maintaining a fixed print gap. The presser foot extends into the record feed path so that records are deflected downwardly as schematically illustrated in FIG. 6, thereby maintaining a fixed print gap distance $d_1$. The presser foot is provided with a sloping upstream surface 50 so that records are deflected under the presser foot, and sloping slide surfaces 52 to facilitate movement of the presser foot back and forth over the records.

In accordance with the present invention, a presser foot 54 is slidably mounted in slots 56, 58 (FIG. 4) provided in the inwardly facing sides of arms 24 and 26, respectively, so as to be movable in a direction normal to the plane of a record as the record moves through the print station 10. Presser foot 54 is provided with a vertically extending projection 60 having a hole 62 and a rod-like cantilever spring 64 (FIG. 3) extends through the hole. Arms 24, 26 are each provided with a hole 66 (FIG. 3) and the ends of spring 64 are supported in these holes.

Figure 7:
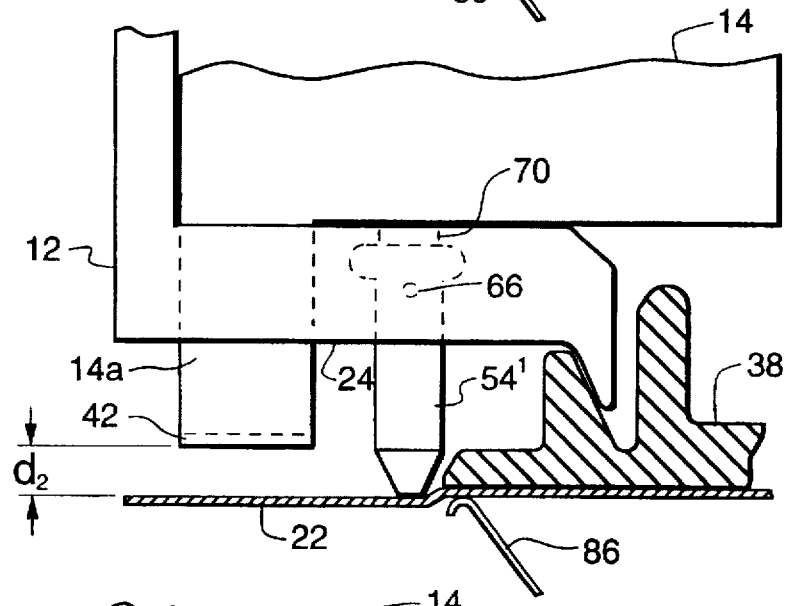
FIG. 7 is a view, similar to FIG. 6, illustrating operation of the presser foot in combination with a cartridge having a projecting surface which acts against the presser foot so as to provide a nozzle to record gap distance $d_2$; and, FIG. 8 is a view, similar to FIG. 6, illustrating operation of the presser foot in combination with a cartridge having a flat surface which acts against the presser foot so as to provide a nozzle to record gap distance $d_3$.
Figure 8:
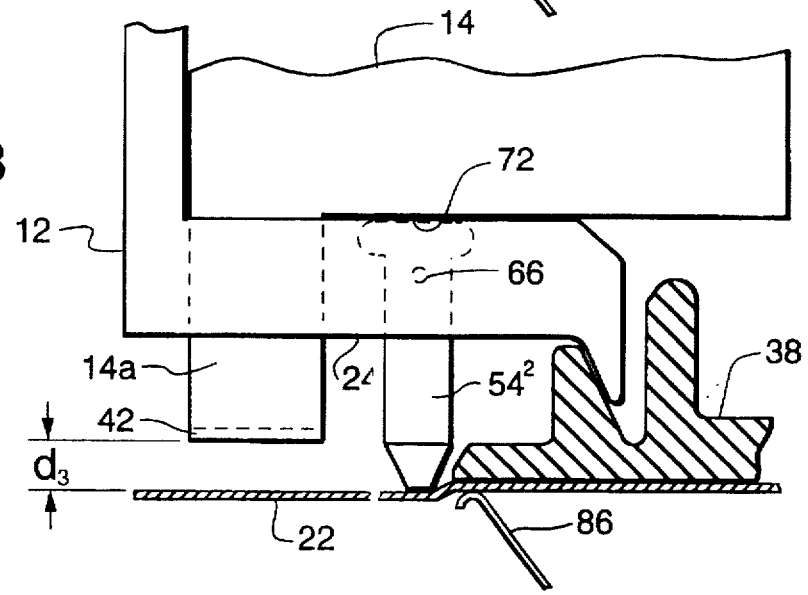

When a cartridge 14 is mounted on carrier 12, a surface feature on the bottom of the cartridge acts against the top surface 60*a* of projection 60 to press the presser foot downwardly against the tension of spring 64. The surface feature may take the form of a recess 68 in the bottom surface of the cartridge as shown in FIG. 6, a projection 70 on the bottom surface as shown in FIG. 7, or a flat bottom surface 72 of the cartridge as shown in FIG. 8. The vertical dimension of the presser foot may be greater when the surface features of the cartridges are recesses than when the surface features are projections hence the presser foot is designated $54^1$ in FIG. 7. In FIG. 8, the presser foot $54^2$ may have a vertical dimension like that of either presser foot 54 or $54^1$ depending on whether the cartridges are to be provided with surface features in the form of recesses varying over a range of different depths to a flat surface, or surface features in the form of projections varying over a range of heights to a flat surface.

By proper choice of the vertical dimension of the presser foot, the same range of adjustment of the print gap distance may be obtained using either recesses or projections as the surface features on the cartridge. That is, the print gap distance $d_1$ of FIG. 6 may be, but does not have to be, equal to the print gap distance $d_2$ shown in FIG. 7.

It should be understood that the drawings, particularly FIGS. 1 and 4–6 are not drawn to scale but are instead drawn to illustrate the principles of the invention. The optimum print gap, that is, the nozzle plate to record gap distance $d_1$, $d_2$, or $d_3$, is typically on the order of 0.032" for some monochrome cartridges and 0.042" for some color cartridges. This is due to the fact that 1, 2 or 3 drops of ink may be required to print a particular color. The more drops required to print a color, the higher the level of the drop on the record and, consequently, the farther away the printhead should be from the record.

Referring to FIG. 1, the record 22, which may be a sheet of paper, an envelope, card stock, transparency or the like, is fed into the print station by pairs of feed rollers 74, 76 mounted on shafts 78, 80 which rotate in printer side frames (not shown). Feed rollers 76 extend through openings 82 in a mid-frame or bedplate 84 to engage the record.

The mid-frame 84 is shaped such that it diverges from the paper feed path in the region beneath the path of cartridge 14 so that a record is not supported by the mid-frame at the print station 10. An elongated, generally V-shaped plastic record deflector 86 is mounted on the mid-frame 84 and serves to press a record upwardly against the bottom surface of guide rail 38. Deflector 86 is held in position by mid-frame projections 88 which extend through spaced openings in the deflector and projections 90 which abut one end of the deflector.

The mid-frame 84 forms a well in which an elongated ink-absorbing pad 92 is disposed. The pad 92 lies beneath the path of the ink-ejecting nozzles provided in nozzle plate 42. The pad 92 serves to absorb ink ejected from the nozzle when there is no record at the print station as, for example, when the nozzles are fired for maintenance purposes to clear the nozzles of debris and dried ink.

A plurality of star rollers 94 cooperate with a plurality of feed rollers 96 to feed a record from the printing station to a stacker bin (not shown).

Referring to FIGS. 1 and 6, as a record 22 is moved by feed rollers 74 and 76 to the left, the leading edge of the record is guided between the upper surface of mid-frame 84 and the lower surface of the guide rail 38. As the record is moved further to the left, the leading edge of the record strikes the deflector 86 and the record is deflected upwardly so that it moves immediately adjacent the bottom surface of the guide rail.

Upon further leftward movement the leading edge of the record strikes the sloping upstream surface 50 of presser foot 54 and is lightly deflected downwardly so as to pass underneath the presser foot. The sloping surface 50 as well as the sloping side surface 52 are greatly exaggerated in FIGS. 6–8 for the purpose of illustrating them. As the record advances, its leading edge is guided onto the top surface **84*a* of mid-frame 84 by the curved mid-frame surface 84*b*. The record is then guided between feed rollers 94 and 96** and ejected into the stacker bin.

As the record is fed along the record path past the printing station, the carrier 12 is moved back and forth transverse to the direction of record feed so as to move the cartridge 14 and foot 54 over the record. As the carrier moves, the nozzles in the nozzle plate 42 are selectively fired in a conventional manner to eject ink from the nozzles and onto the upper surface of the record.

From FIG. 1, it is evident that the vertical position of the bottom of presser foot 54 determines the print gap distance between the nozzles in nozzle plate 42 and the top surface of record 22. Furthermore, from FIGS. 6–8 it is evident that the vertical position of the bottom of the presser foot 54 is determined by how far the presser foot is depressed by a cartridge 14 acting against the force of the presser foot bias spring 64. The spring 64 exerts a much smaller force on cartridge 14 (via presser foot projection 60) than the latch 46 exerts on the cartridge so that the projections 47 on the cartridge are always firmly pressed against lands **24*a*, 26*a*. Therefore, the optimum nozzle to record print gap distance for a given cartridge may be obtained by providing the bottom of that cartridge with a surface feature 68, 70 or 72 which depresses the presser foot so that the bottom of the presser foot is the desired gap distance $d_1$, $d_2$ or $d_3$ below the level of the bottom surface of nozzle plate 42. The surface feature on a cartridge, in effect, defines the optimum print gap distance for that in effect, defines the optimum print gap distance for that cartridge and the presser foot 54 is automatically vertically adjusted to provide that gap distance when the cartridge is mounted on the carrier 12**.

From the foregoing description it is seen that the present invention provides a novel cartridge/cartridge carrier arrangement which automatically provides the optimum print gap distance. Furthermore, the invention permits the manufacture of a large number of cartridges having the same "standard" dimensions with the cartridges then being modified by a simple manufacturing step so that various ones of the cartridges result in different print gap distances when mounted on a cartridge carrier. For example, all cartridges may be initially formed with bottom surfaces of the same dimensions and then the bottom surfaces of individual cartridges ground down or bored by different amounts to give the cartridges differing surface features yielding different print gap distances when the cartridges are mounted on a cartridge carrier.

Although preferred embodiments have been described in detail to illustrate the principles of the invention, it will be obvious that various substitutions and modifications may be made in the described embodiments without departing from the spirit and scope of the invention as defined by the appended claims.

We claim:

1. An ink-jet printer comprising:

an ink cartridge having an array of ink-ejecting nozzles thereon;

a cartridge carrier for moving said cartridge transverse to a direction of record feed past said nozzles; and a presser foot movably mounted on said cartridge carrier for establishing a print gap distance between said nozzles and a record moving past said nozzles; and, means for moving said presser foot normal to said direction of record feed to thereby set a print gap distance between said nozzles and records fed past said nozzles, said print gap distance being the optimum gap distance for said cartridge.

2. An ink-jet printer as claimed in claim 1 wherein said presser foot is mounted on a rod-like spring having ends supported in said cartridge carrier.

3. An ink-jet printer as claimed in claim 1 wherein said presser foot is slidably mounted in grooves provided in said cartridge carrier.

4. An ink-jet printer as claimed in claim 3 and further comprising a cantilever spring extending through said presser foot, said spring having ends supported by said cartridge carrier.

5. An ink-jet printer as claimed in claim 1 and further comprising a deflector for deflecting records into contact with said presser foot as the records move along a record feed path, said presser foot having a sloping surface which is contacted by leading edges of said records.

6. An ink-jet printer as claimed in claim 1 and further comprising a grooved guide rail disposed transverse to said direction of record feed, said cartridge carrier comprising a generally vertical portion, two arms extending from said vertical portion and having lands upon which said cartridge is supported, said arms having feet which ride in said grooved guide rail.

7. An ink-jet printer as claimed in claim 1 wherein said means for moving said presser foot comprises a surface feature on said cartridge which engages and moves said presser foot as the cartridge is mounted on said cartridge carrier whereby said gap distance is determined by said surface feature.

8. An ink-jet printer as claimed in claim 7 and further comprising a bias spring supporting said presser foot so that a top surface of said presser foot is engaged by said surface feature to move said presser foot against a force exerted by said bias spring.

9. An ink-jet printer as claimed in claim 7 wherein said presser foot includes an upwardly extending projection and said surface feature is a recess in a bottom surface of said cartridge for receiving said projection.

10. An ink-jet printer as claimed in claim 7 wherein said surface feature is a projection on a bottom surface of said cartridge.

11. An ink-jet printer cartridge having an ink reservoir therein and having a nozzle array for ejecting ink onto a surface of a record, said cartridge having a surface feature thereon configured to automatically adjust the nozzle to record gap distance when the cartridge is mounted in a printer, said surface feature consisting one of the group of features consisting of a surface recess and a surface projection.

12. An ink-jet printer comprising:

a cartridge having a reservoir for holding ink and a plurality of nozzles for ejecting ink;

a cartridge carrier supported for movement above a record feed path and transverse to a direction in which a record moves along said feed path, said cartridge being mounted on said cartridge carrier;

a presser foot mounted on said cartridge carrier for guiding records moving along the record feed path to thereby establish a print gap distance between said nozzles and records; and, a spring for exerting a bias force on said presser foot;

said presser foot being slidably supported by said cartridge carrier for movement generally normal to the record feed path, said cartridge having a surface feature engaging said presser foot to move said presser foot against the force of said bias spring to thereby adjust said print gap distance to an optimum distance for best print quality.

* * * * *